US010697331B2

(12) United States Patent
Meyers et al.

(10) Patent No.: US 10,697,331 B2
(45) Date of Patent: Jun. 30, 2020

(54) VALVE ACTUATING MECHANISM HAVING COMBINED BEARING AND HYDRAULIC LASH ADJUSTER RETENTION DEVICE

(71) Applicant: GT Technologies, Westland, MI (US)

(72) Inventors: Mark Meyers, Warren, MI (US); Luke Gossman, Canton, MI (US); John Brune, Stockbridge, MI (US)

(73) Assignee: GT Technologies, Westland, MI (US)

( * ) Notice: Subject to any disclaimer, the term of this patent is extended or adjusted under 35 U.S.C. 154(b) by 0 days.

(21) Appl. No.: 16/142,647

(22) Filed: Sep. 26, 2018

(65) Prior Publication Data

US 2020/0095902 A1 Mar. 26, 2020

(51) Int. Cl.
*F01L 1/18* (2006.01)
*F01L 1/24* (2006.01)

(52) U.S. Cl.
CPC ..... *F01L 1/18* (2013.01); *F01L 1/185* (2013.01); *F01L 1/2405* (2013.01); *F01L 2001/187* (2013.01)

(58) Field of Classification Search
CPC ... F01L 1/185; F01L 1/2405; F01L 2001/187; F01L 2105/00; F01L 1/18
USPC ..... 123/90.39, 90.16, 90.41, 90.43, 90.44
See application file for complete search history.

(56) References Cited

U.S. PATENT DOCUMENTS 5,775,280 A 7/1998 Schmidt et al.
9,157,340 B2 10/2015 Smith et al.
9,482,120 B2 11/2016 Brune et al.
2003/0101954 A1* 6/2003 Pierik ..... F01L 1/185 123/90.39
2008/0196682 A1 8/2008 Moeck et al.
(Continued)

FOREIGN PATENT DOCUMENTS

DE 102005036918 A1 2/2007
DE 102008029293 A1 12/2009
DE 102008052280 A1 4/2010
(Continued)

OTHER PUBLICATIONS

DE-102012221661 English langauge machine translation.*
DE-102014208005 English langauge machine translation.*

*Primary Examiner* — Patrick Hamo
*Assistant Examiner* — Wesley G Harris
(74) *Attorney, Agent, or Firm* — Howard & Howard Attorneys PLLC

(57) ABSTRACT

A retention device for interconnecting a lash adjuster and a finger follower that supports a bearing of a valve actuating mechanism for an internal combustion engine, wherein the retention device includes a body having a lower member, an upper member spaced from the lower member, and an intermediate member interconnecting the lower and upper members. The lower member includes an aperture that is adapted to be received in a groove of the lash adjuster. The intermediate member is secured to the finger follower such that the retention device interconnects the lash adjuster and the finger follower. The upper member includes a bearing retention mechanism that limits movement of the bearing of the finger follower and retains the bearing relative to the finger follower prior to mounting the finger follower and lash adjuster as a part of the valve actuating mechanism of the internal combustion engine.

20 Claims, 8 Drawing Sheets

(56) References Cited

U.S. PATENT DOCUMENTS

2014/0041604 A1* 2/2014 Trpcevski ..... F01L 1/00
123/90.1

FOREIGN PATENT DOCUMENTS

DE 102012221661 A1 * 11/2012 ..... F01L 1/18
DE 102014208005 A1 * 4/2014 ..... F01L 1/18

* cited by examiner

VALVE ACTUATING MECHANISM HAVING COMBINED BEARING AND HYDRAULIC LASH ADJUSTER RETENTION DEVICE

BACKGROUND OF THE INVENTION

1. Field of the Invention

The present invention relates, generally, to engine valvetrain systems and, more specifically, to a valve actuating mechanism for use in an internal combustion engine having a combined bearing and hydraulic lash adjuster retention device.

2. Description of the Related Art

Conventional engine valvetrain systems known in the art typically include one or more camshafts in rotational communication with a crankshaft supported in a block, one or more intake and exhaust valves supported in a cylinder head, and one or more valve actuating mechanism for translating radial movement from lobes of the camshaft into linear movement of the valves. The valves are used to regulate the flow of gasses in and out of cylinders of the block. The valves each have a head and a stem extending therefrom. The valve head is configured to periodically seal against the cylinder head. To this end, a compression spring is typically supported in the cylinder head, is disposed about the valve stem, and is operatively attached to the valve stem via a spring retainer. The valve stem is typically supported by a valve guide that is also operatively attached to the cylinder head, whereby the valve stem extends through the valve guide and travels therealong in response to engagement from the valve actuating mechanism.

As the camshaft rotates, the valve actuating mechanism translates force from the lobes into linear movement of the valve between different positions. The two most conventional valve positions are commonly referred to as "valve open" and "valve closed". In the valve closed position, potential energy from the loaded spring holds the valve head sealed against the cylinder head. In the valve opened position, the valve actuating mechanism translates linear movement to compress the spring, thereby un-sealing the valve head from the cylinder head so as to allow gasses to flow into (or, out of) the cylinder of the block.

In modern "overhead cam" valvetrain systems, the valve actuating mechanism typically includes a lash adjuster and a finger follower (sometimes referred to in the art as a "rocker arm finger follower"). The lash adjuster is typically supported in the cylinder head at a location spaced from the valve stem, with a lobe of the camshaft disposed above ("overhead of") the lash adjuster and the valve stem. Conventional lash adjusters utilize hydraulic oil pressure from the engine to maintain certain tolerances between the valve stem and the camshaft lobe under varying engine operating conditions, such as engine rotational speed or operating temperature. Thus, in operation, force from the camshaft lobe is translated through the finger follower to the lash adjuster and the valve stem. To that end, the finger follower has a body which extends between and engages the lash adjuster and the valve stem, and also includes a bearing that engages the camshaft lobe. The bearing is typically supported by a shaft which, in turn, is supported in the body of the finger follower. The bearing rotates on the shaft, follows the profile of the lobe of the camshaft, and translates force to the finger follower, via the shaft, so as to open the valve in response to rotation of and engagement with the camshaft lobe.

The valve actuating mechanism including the finger follower and hydraulic lash adjuster is often supplied as a unit for later assembly to the cylinder head of an internal combustion engine. Prior to final assembly on the internal combustion engine, some of the components of a typical valve actuating mechanism are loosely associated with one another, but can become separated during shipping and handling prior to final assembly. For example, the hydraulic lash adjuster has been known to separate from the socket formed in the finger follower and bearings have been known to separate from the finger follower.

Under these circumstances, retention devices have been employed to interconnect the hydraulic lash adjuster and the finger follower during shipping and handling and prior to final installation of the valve actuating mechanism to a cylinder head. While the retention devices of the type generally known in the art have worked for their intended purposes, certain disadvantages remain. For example, retention devices of the type known in the art are not designed to secure the bearing to the finger follower. Thus, there remains a need in the art for a valve actuating mechanism including a retention device that operatively interconnects the finger follower to the hydraulic lash adjuster while also acting to prevent the bearing from separating from the finger follower during shipping or handling and prior to the final assembly of the valve actuating mechanism to a cylinder head of an internal combustion engine.

SUMMARY OF THE INVENTION

The present invention overcomes the disadvantages in the related art in a retention device for interconnecting a lash adjuster and a finger follower that supports a bearing of a valve actuating mechanism for an internal combustion engine. The retention device includes a body having a lower member, an upper member spaced from the lower member and an intermediate member interconnecting the lower and upper members. The lower member includes an aperture which is adapted to be received in a groove of the lash adjuster. The intermediate member is secured to the finger follower such that the retention device acts to interconnect the lash adjuster and finger follower. The upper member includes a bearing retention mechanism that limits movement of the bearing of the finger follower and retains the bearing relative to the finger follower prior to mounting the finger follower and lash adjuster as a part of the valve actuating mechanism to a cylinder head of an internal combustion engine.

In this way, the present invention operatively interconnects the finger follower to the hydraulic lash adjuster while also acting to prevent the bearing from separating from the finger follower during shipping or handling and prior to final assembly to the cylinder head of an internal combustion engine. Other objects, features and advantages of the present invention will be readily appreciated as the same becomes better understood after reading the subsequent description taken in connection with the accompanying drawings.

BRIEF DESCRIPTION OF THE DRAWINGS

Other objects, features, and advantages of the present invention will be readily appreciated as the same becomes better understood after reading the subsequent description taken in connection with the accompanying drawings.

DETAILED DESCRIPTION OF THE INVENTION

Figure 1:
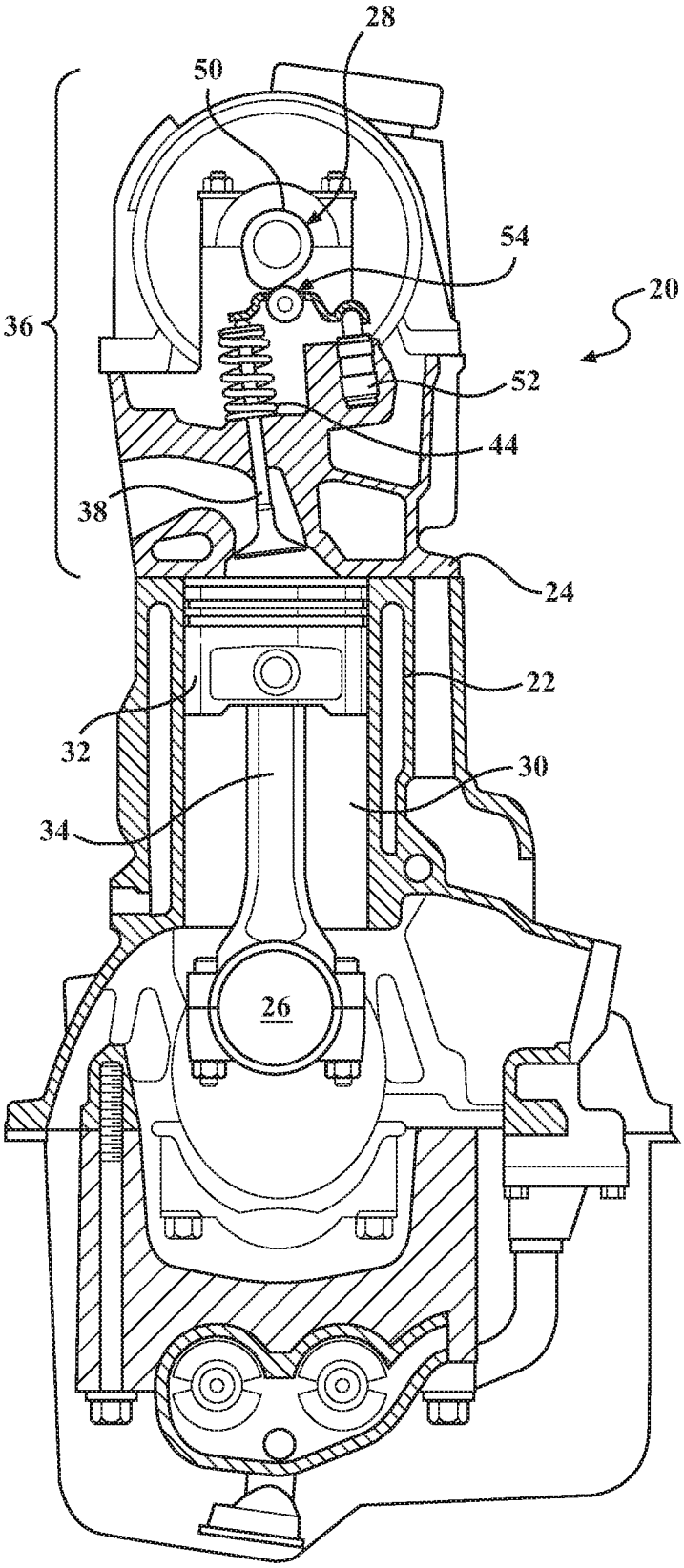
FIG. 1 is a partial front sectional view of an automotive engine with an overhead-cam configuration including a valvetrain mounted in a cylinder head.

Referring now to the drawings, where like numerals are used to designate like structure, a portion of an internal combustion engine is generally indicated at 20 in FIG. 1. The engine 20 includes a block 22 and a cylinder head 24 mounted to the block 22. A crankshaft 26 is rotatably supported in the block 22, and a camshaft 28 is rotatably supported in the cylinder head 24. The crankshaft 26 drives the camshaft 28 via a timing chain or belt (not shown, but generally known in the art). The block 22 typically includes one or more cylinders 30 in which a piston 32 is supported for reciprocal motion therealong. The piston 32 is pivotally connected to a connecting rod 34, which is also connected to the crankshaft 26. In operation, combustion in the cylinders 30 of the engine 20 moves the pistons 32 in reciprocal fashion within the cylinders 30.

Reciprocal motion of the piston 32 generates rotational torque that is subsequently translated by the crankshaft 26 to the camshaft 28 which, in turn, cooperates with a valvetrain, generally indicated at 36, to control the flow and timing of intake and exhaust gasses between the cylinder head 24, the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20. To that end, the valves 38 each have a head 40 and a stem 42 extending therefrom (see FIG. 2). The valve head 40 is configured to periodically seal against the cylinder head 24 adjacent the cylinder 30, such as with a compression spring 44 supported in the cylinder head 24, disposed about the valve stem 42, and operatively attached to the valve 38 via a retainer 46. The valve stem 42 is typically supported by a valve guide 48 that is also operatively attached to the cylinder head 24, such that the valve stem 42 extends through the valve guide 48 and travels therealong in response to force translated via rotation of the camshaft 28 (see FIG. 2). To this end, the camshaft 28 has lobes 50 with a predetermined profile configured to cooperate with the valvetrain 36 such that radial movement from the camshaft 28 is translated into linear movement of the valves 38 so as to control the valve events, as discussed above.

Figure 2:
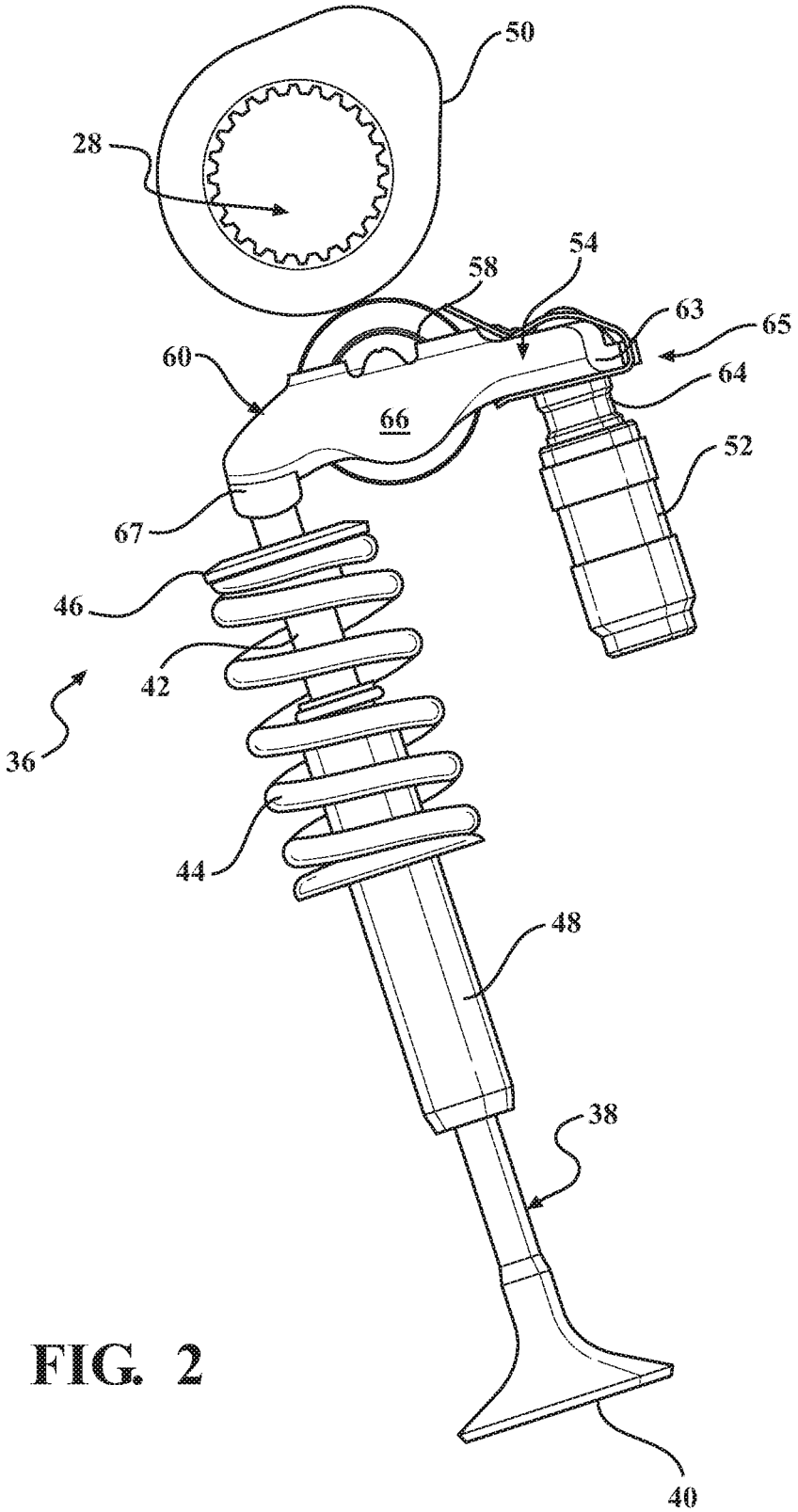
FIG. 2 is a front view of a portion of the valvetrain of FIG. 1 showing a valve, a camshaft, a lash adjuster, and a finger follower assembly according to one embodiment of the present invention.

With continued reference to FIGS. 1 and 2, the representative embodiment of the valvetrain 36 illustrated herein also employs a valve actuating mechanism including a lash adjuster 52 and a finger follower assembly (sometimes referred to in the related art as a "rocker arm finger follower"), generally indicated at 54 and according to one embodiment of the present invention. Conventional lash adjusters 52 utilize hydraulic oil pressure from the engine 20 to maintain tolerances between the valve stem 42 and the camshaft lobe 50 under varying engine operating conditions, such as engine rotational speed or operating temperature. To that end, the lash adjuster 52 is supported in the cylinder head 24, is spaced from the valve stem 42, and cooperates with the finger follower assembly 54 to effect translation of force to the valve 38, as will be described in greater detail below. While the lash adjuster 52 shown in FIGS. 1 and 2 is a hydraulic lash adjuster, it will be appreciated that the lash adjuster 52 could be of any suitable type or configuration without departing from the scope of the present invention.

Those having ordinary skill in the art will recognize the valvetrain 36 described herein as what is commonly referred to as an "overhead cam" configuration, such that rotation of the camshaft 28 is translated to the finger follower assembly 54 which, in turn, engages and directs force to the valve 38 and the lash adjuster 52. While the engine 20 illustrated in FIG. 1 is an inline-configured, single overhead cam, spark-ignition, Otto-cycle engine, those having ordinary skill in the art will appreciate that the engine 20 could be of any suitable configuration, with any suitable number of cylinder heads 24 and/or camshafts 28 disposed in any suitable way, controlled using any suitable thermodynamic cycle, and with any suitable type of valvetrain 36, without departing from the scope of the present invention. By way of non-limiting example, the engine 20 could be a so-called "dual overhead-cam V8" with an eight-cylinder V-configured block 22 and a pair of cylinder heads 24 each supporting a respective pair of camshafts 28 (not shown, but generally known in the art). Further, while the engine 20 is configured for use with automotive vehicles, those having ordinary skill in the art will appreciate that the present invention could be used in any suitable type of engine 20. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As noted above, the valve actuating mechanism also includes a finger follower assembly 54 for use in the engine 20 valvetrain 36. More specifically, the finger follower assembly 54 cooperates with the valve 38, the lobe 50 of the camshaft 28, and the lash adjuster 52. As will be appreciated from the subsequent description below, the finger follower assembly 54 can be configured in a number of different ways without departing from the scope of the present invention.

Figure 3:
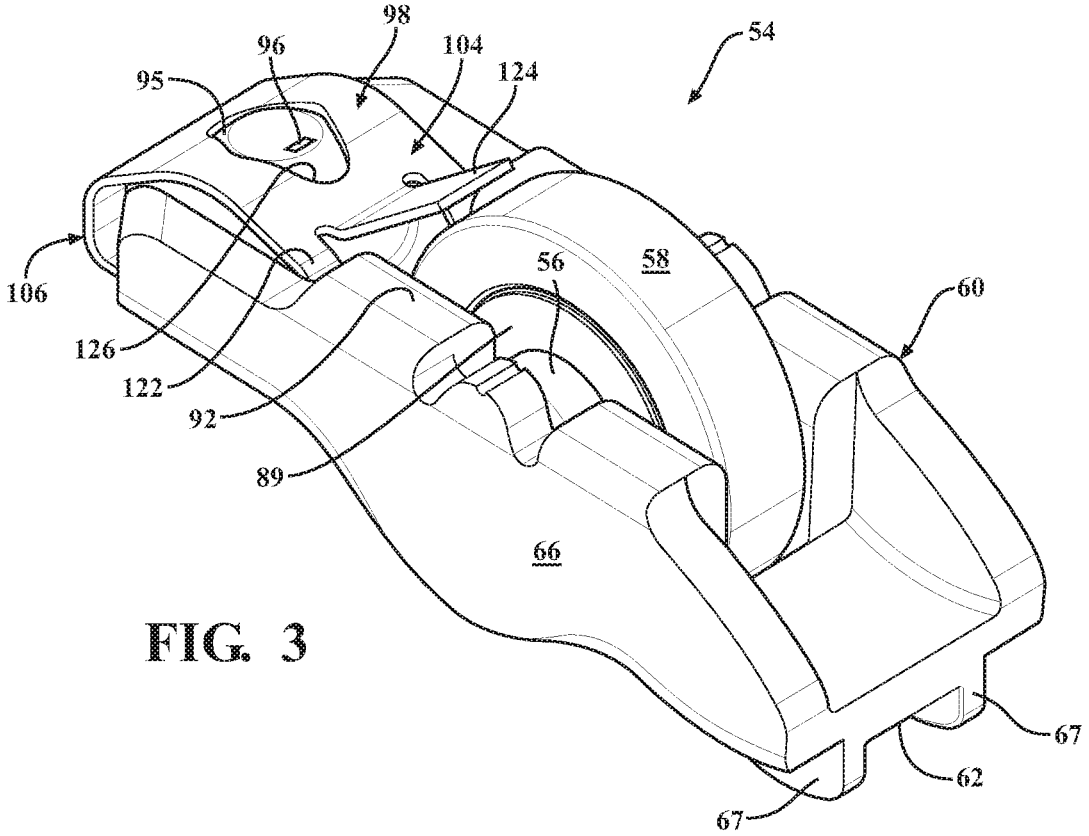
FIG. 3 is a top, rear-side perspective view of the finger follower assembly of FIG. 2.
Figure 4:
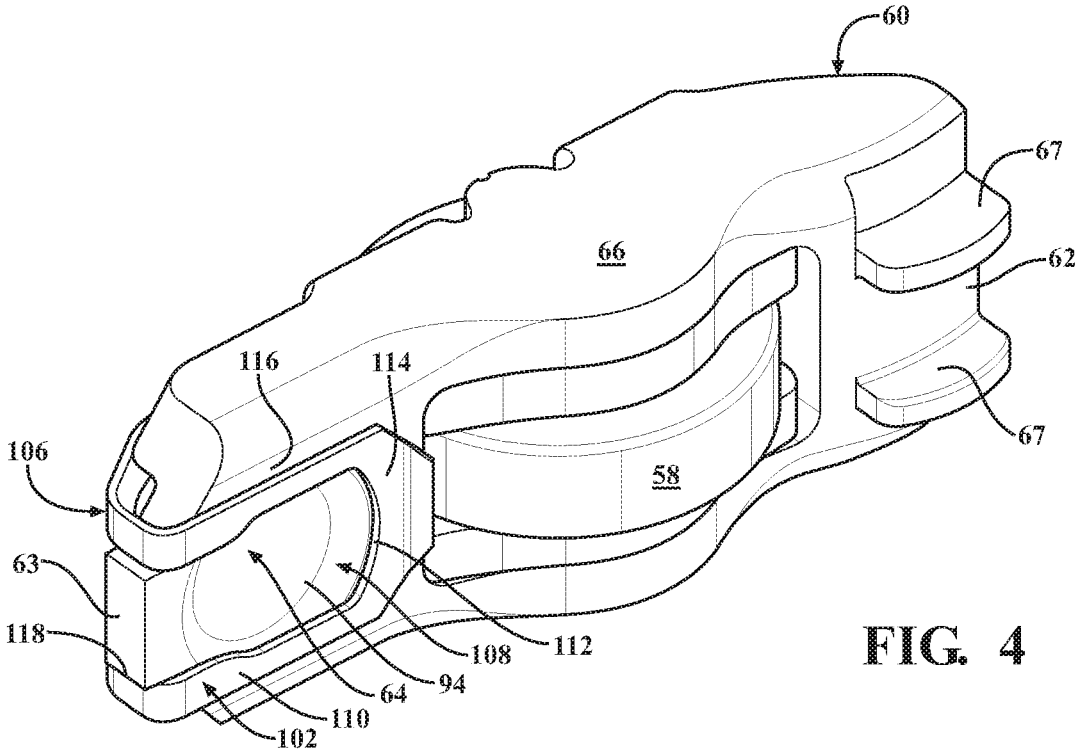
FIG. 4 is a bottom, front-side perspective view of the finger follower assembly of FIGS. 2-3.
Figure 5:
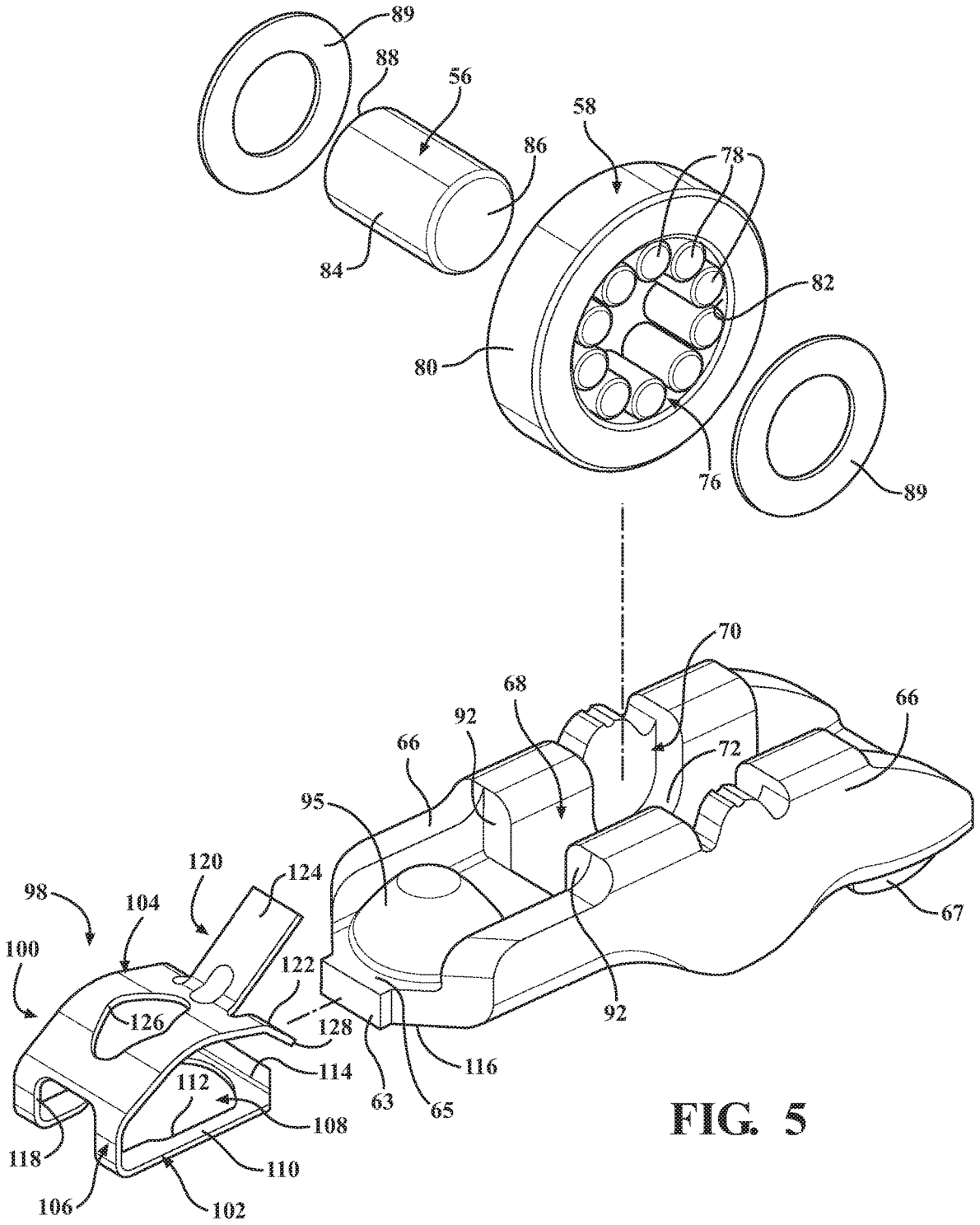
FIG. 5 is an exploded perspective view of the finger follower assembly of FIGS. 2-4, shown having: a shaft; a bearing; and a body provided with a socket, a pad, and a pair of walls each having a slot defined therein.
Figure 6:
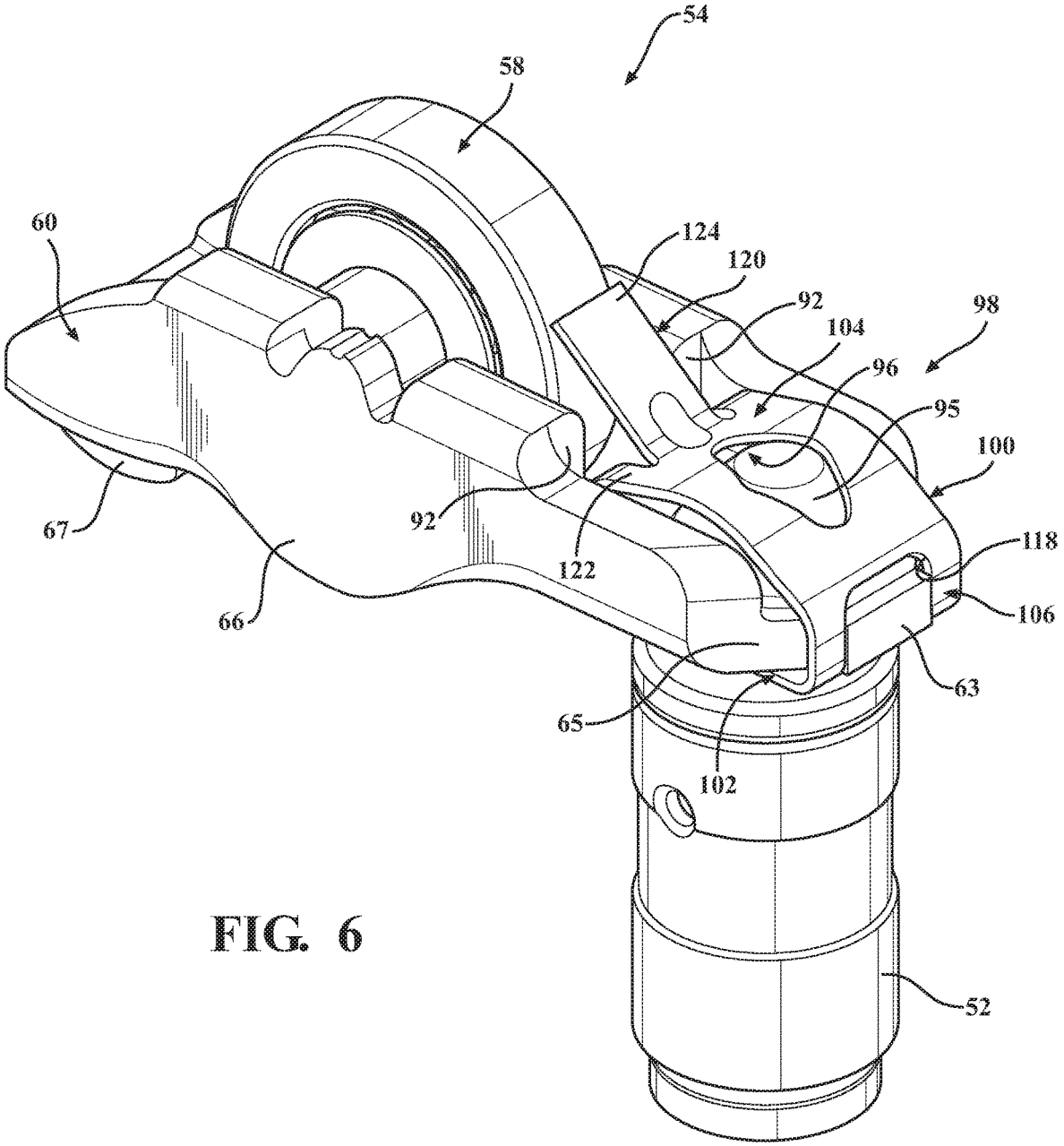
FIG. 6 is a perspective view of the finger follower assembly of the present invention showing the retention device interconnecting the lash adjuster and finger follower and retaining the bearing.
Figure 8:
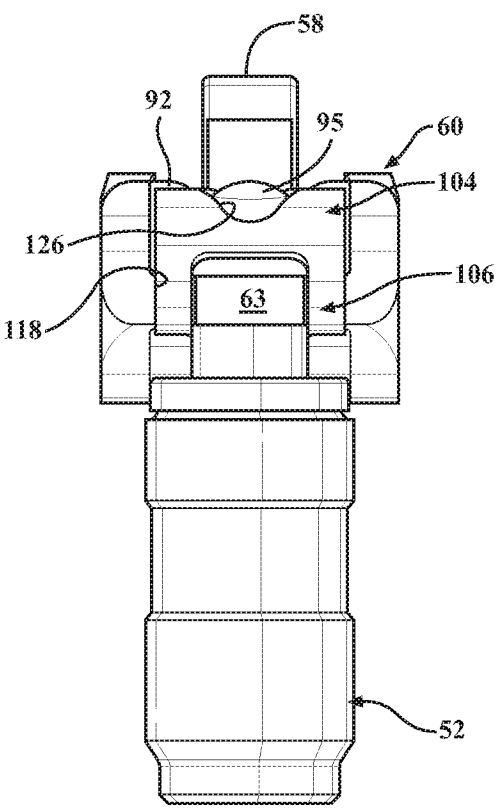
FIG. 8 is a front elevational view of the valve actuating mechanism of the present invention showing the retention device interconnecting the lash adjuster and the finger follower.
Figure 7:
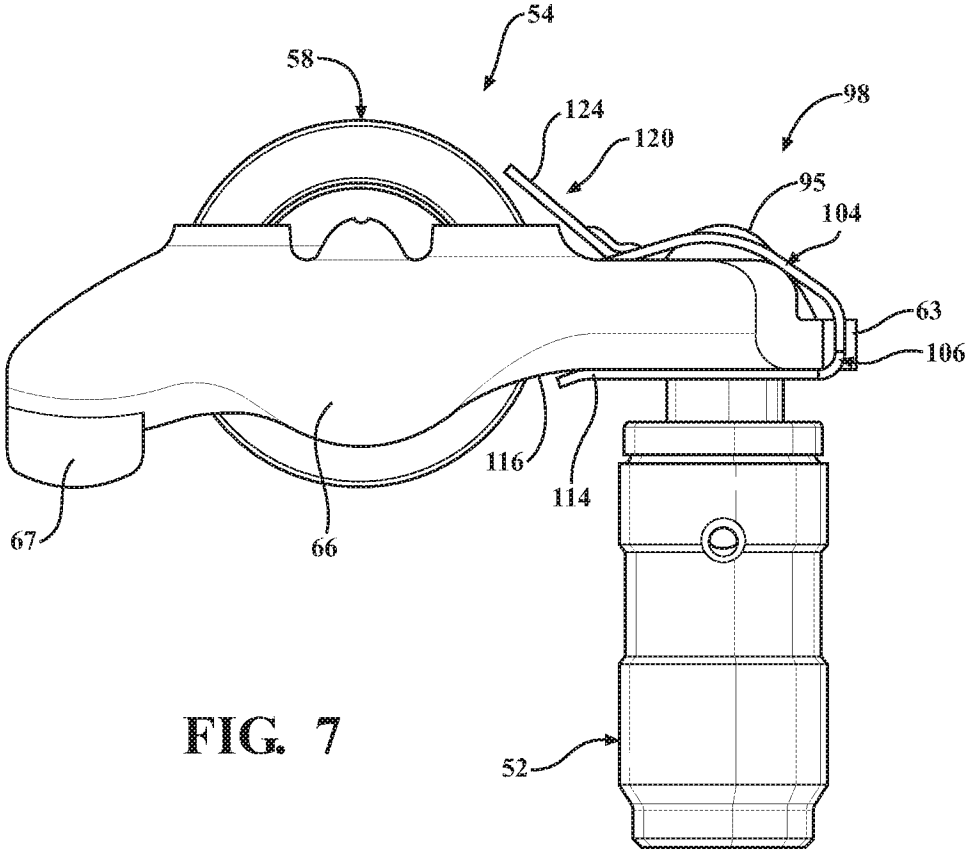
FIG. 7 is a side elevational view of the valve actuating mechanism of the present invention showing the retention device interconnecting the lash adjuster and the finger follower.
Figure 10:
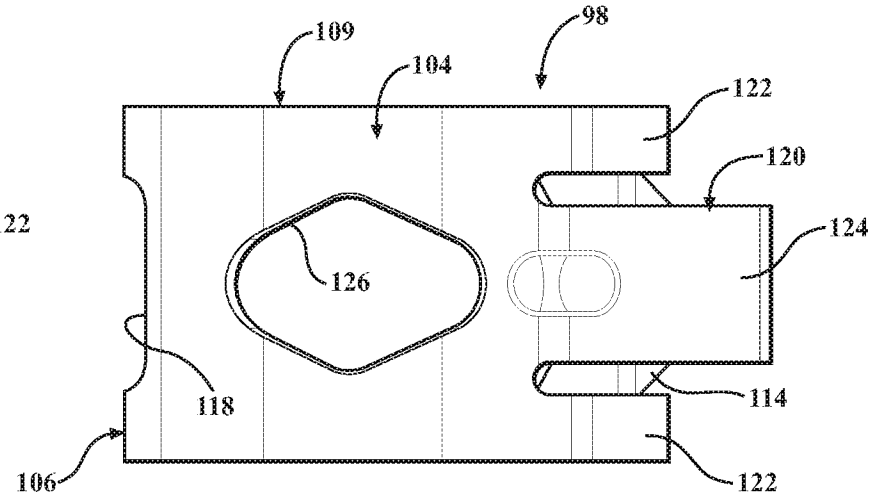
FIG. 10 is a plan view of the retention device according to the present invention.
Figure 12:
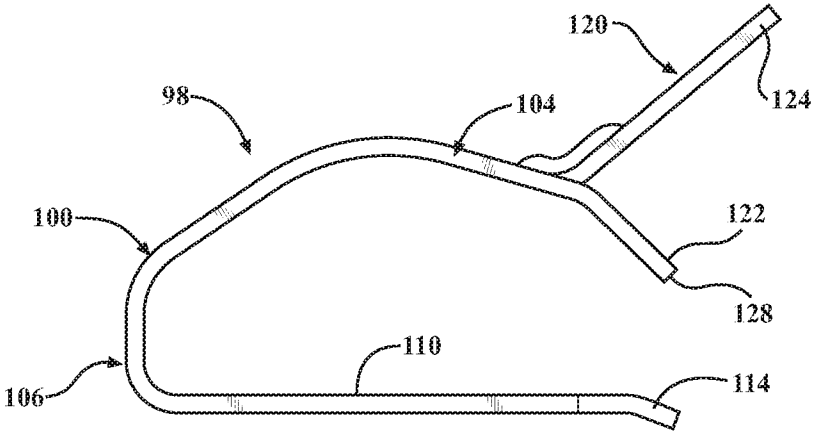
FIG. 12 is a side elevational view of the retention device according to the present invention.
Figure 9:
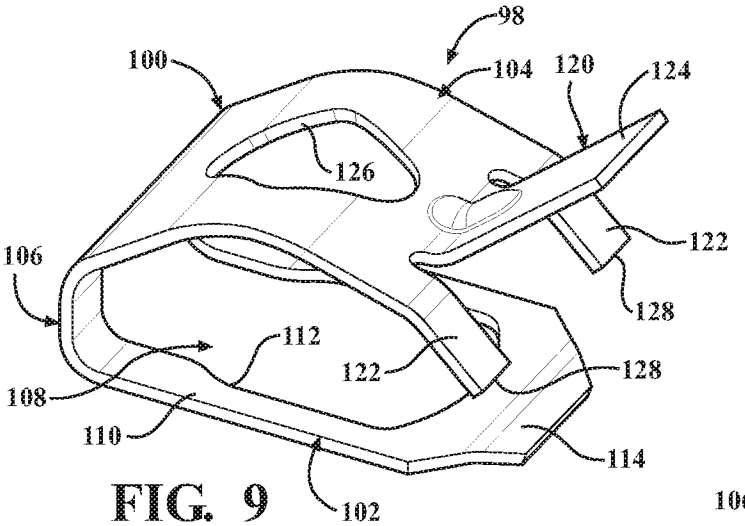
FIG. 9 is a perspective view of the retention device according to the present invention.
Figure 11:
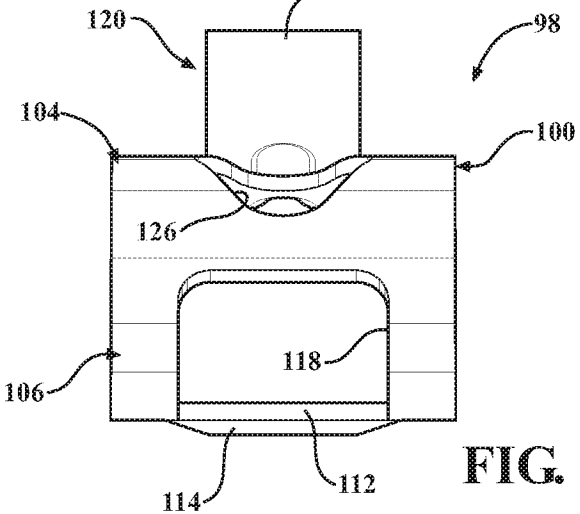
FIG. 11 is a front elevational view of the retention device of the present invention.

Referring now to FIGS. 3-5, one embodiment of the finger follower assembly 54 of the present invention is shown in detail. The finger follower assembly 54 includes a shaft 56, a bearing 58, and a body, generally indicated at 60. The bearing 58 is rotatably supported by the shaft 56 and is adapted to engage the lobe 50 of the camshaft 28. More specifically, the bearing 58 follows the profile of the lobe 50 such that when the camshaft 28 rotates, force is translated to the bearing 58 which simultaneously rotates the bearing 58 about the shaft 56 and urges the bearing 58 away from the camshaft 28 toward the valve 38 and the lash adjuster 52. Here, force that urges the bearing 58 away from the camshaft 28 is translated to the body 60 via the shaft 56, whereby the body 60 subsequently translates force to the lash adjuster 52 and the valve stem 42 to open the valve 38 so as to control the flow of gasses into (or, out of) the cylinder 30, as discussed above. To that end, the body 60 includes a pad 62 for engaging the valve 38, and a socket 64 spaced longitudinally from the pad 62 that receives the rounded end 53 of the lash adjuster 52. A pair of flanges 67 flank the pad 62 and are disposed on either side of the terminal end of the valve stem 42. The pad 62 and the socket 64 are adapted to press against and remain substantially engaged to the valve 38 and the lash adjuster 52, respectively, as the camshaft 28 rotates in operation (see also FIG. 2). The finger follower 54 also includes a tab 63 that extends from the distal end 65 of the body 60 of the finger follower 54 opposite the pad 62 for a purpose which will be described in greater detail below.

As noted above, the finger follower assembly 54 is described herein and illustrated throughout the drawings as forming part of an overhead-cam style valvetrain 36 of an engine 20. However, as will be appreciated from the description below, the finger follower assembly 54 of the present invention can be readily implemented as a part of any suitable valvetrain 36 in which the camshaft lobe 50 engages the bearing 58 of the finger follower assembly 54 to translate rotation of the lobe 50 into movement of the valve 38. Thus, it will be appreciated that terms-of-the-art such as "lash adjuster," "finger follower," and the like as used herein are intended to be non-limiting. Put differently, the present invention affords significant opportunities for use in a number of different systems where a valve actuating mechanism employs rollers or bearings to effect translation of camshaft lobe rotation into valve movement using a hydraulic lash adjuster 52.

As is shown best in FIGS. 3-5, the body 60 includes a pair of walls 66 spaced laterally from each other and disposed between the pad 62 and the socket 64. The walls 66 define a valley therebetween, generally indicated at 68, for accommodating the bearing 58 and a portion of the shaft 56. The body 60 also includes a slot, generally indicated at 70, formed in each of the walls 66. Here, the slots 70 cooperate to support the shaft 56 with respect to the body 60. To this end, each of the slots 70 has an arc-shaped bearing surface 72. The arc-shaped bearing surfaces 72 are arranged to allow the shaft 56 to rotate within the slots 70 and also to move along the slots 70 so as to facilitate alignment of the bearing 58 with respect to engagement with the lobe 50 of the camshaft 28 independent of alignment of the pad 62 of the body 60 with respect to engagement with the valve 38 and of alignment of the socket 64 of the body 60 with respect to engagement with the lash adjuster 52. The shaft 56, the bearing 58, the body 60, and the slots 70 of the finger follower assembly 54 will each be described in greater detail below.

Figure 13:
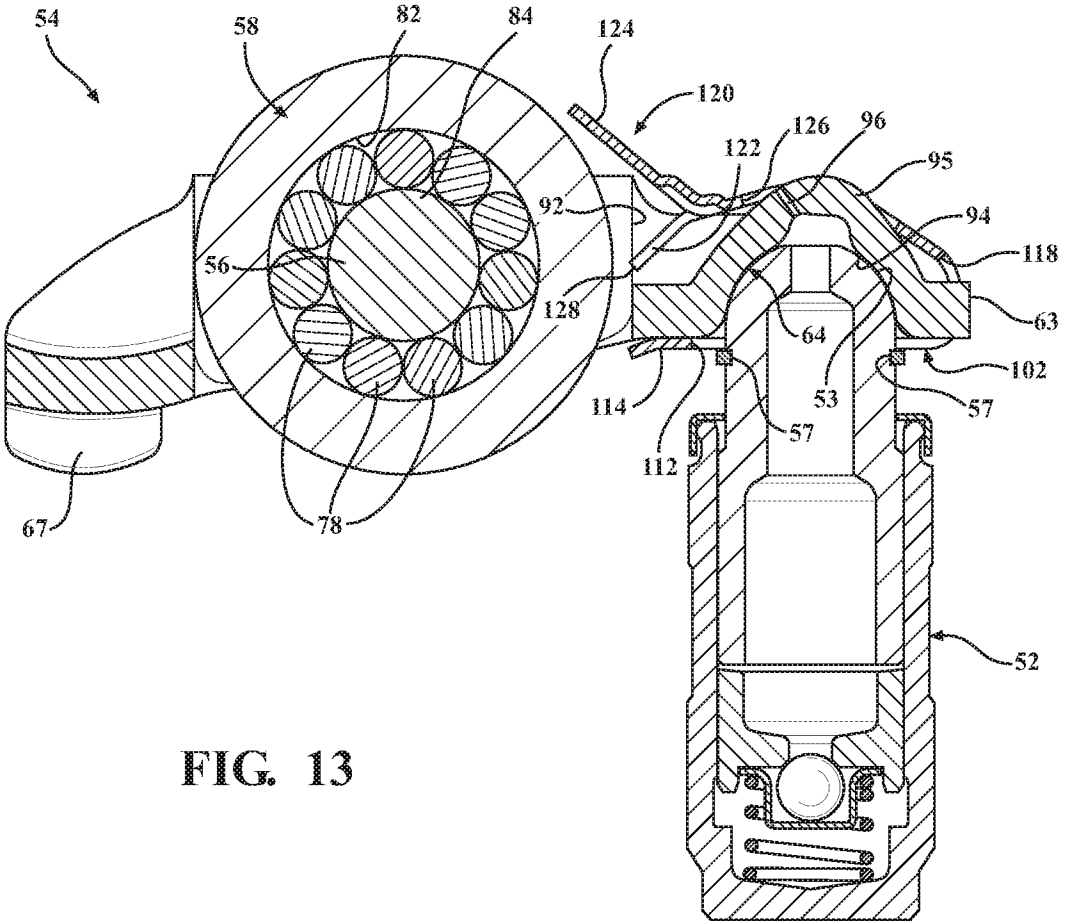
FIG. 13 is a cross-section side view of the valve actuating mechanism having the retention device of the present invention.

In the representative embodiment illustrated herein, and as best shown in FIGS. 5 and 13, the bearing 58 includes a bearing race 76 and a plurality of needle bearing elements 78. Here, the needle bearing elements 78 are interposed between the shaft 56 and the bearing race 76 in a conventional needle bearing arrangement. The bearing race 76 has an annular configuration with an outer race surface 80 and an inner race surface 82 concentrically aligned with the outer race surface 80. The shaft 56, in turn, has a cylindrical configuration with an outer shaft surface 84 extending laterally between a first shaft end 86 and a second shaft end 88. The needle bearing elements 78 likewise each have a cylindrical configuration and are arranged in engagement with both the outer shaft surface 84 of the shaft 56 and the inner race surface 82 of the bearing race 76 such that the shaft 56 is concentrically aligned with the bearing race 76. A pair of washers 89 may be displayed adjacent either end 86, 88 of the shaft 56 and are operatively supplied in the slot 70 while resting on the arc-shaped bearing surface 72. While the bearing 58 described herein and illustrated throughout the drawings employs needle bearing elements 78 and the bearing race 76, those having ordinary skill in the art will appreciate that the bearing 58 could be configured in any suitable way sufficient to rotate about and concentrically with the shaft 56 without departing from the scope of the present invention. By way of non-limiting example, the bearing could be realized as a journal bearing rotatably supported on the shaft (not shown, but known in the related art).

In the representative embodiment illustrated throughout the drawings, the body 60 of the finger follower assembly 54 is formed as a unitary, one-piece component. More specifically, the body 60 is manufactured from a single piece of sheet steel that is stamped, bent, formed, and the like to define and arrange the walls 66, the pad 62, the socket 64, the slots 70, and the valley 68. However, those having ordinary skill in the art will appreciate that the body 60 can be formed in a number of different ways, and from any suitable number of components, so as to facilitate the rotation and translation of the shaft 56 noted above, without departing from the scope of the present invention. In one embodiment, the body 60 also includes a pair of bosses 92 formed on the walls 66 disposed adjacent to and spaced on opposing lateral sides of the bearing 58. Similarly, as best shown in FIG. 13, the socket 64 has a curved pocket 94 for accommodating and aligning with the rounded end 53 of the lash adjuster 52 and a dome-shaped upper surface 95 opposite to the curved pocket 94. In addition, the rounded end 53 of the lash adjuster 52 includes a groove 57 that is spaced from the rounded end 53. The body 60 is also provided with a lubrication arrangement, generally indicated at 96, formed adjacent to the curved pocket 94 of the socket 64 and in conjunction with the hydraulic lash adjuster 52 acts to direct lubricating fluid toward the shaft 56, the bearing 58, the pad 62, and/or other parts of the valvetrain 36. However, those having ordinary skill in the art will appreciate that the body 60 could be configured in a number of different ways without departing from the scope of the present invention.

The valve actuating mechanism of the present invention also includes a retention device generally indicated at 98 that acts to interconnect the lash adjuster 52 and the finger follower 54, while also acting to prevent the bearing 58 from separating from the finger follower 54 during shipping or handling and prior to final assembly to the cylinder head of an internal combustion engine. To this end, and as best shown in FIGS. 6-13, the retention device 98 includes a body generally indicated at 100 having a lower member generally indicated at 102, an upper member, generally indicated at 104, spaced from the lower member, and an intermediate member, generally indicated at 106, interconnecting the lower and upper members 102, 104. Each of these components will be described in greater detail below.

The lower member 102 includes an aperture 108 that is adapted to be received in the groove 57 of the lash adjuster 52. More specifically, the lower member 104 includes a clip portion 110 having an inner edge 112 which substantially defines the aperture 108. The edge 112 of the clip portion 110 is received in the groove 57 formed in the lash adjuster 52 or may be otherwise accommodated by a ring or washer that is supported in the groove 57. In this way, the lower member 102 is operatively connected to the lash adjuster 52. In addition, the lower member 102 further includes an end portion 114 that is disposed adjacent to the underside 116 of the body 60 of the finger follower 54.

The intermediate member 106 is secured to the finger follower 54 such that the retention device 48 interconnects the lash adjuster 52 and the finger follower 54. To this end, the intermediate member 106 of the retention device 98 includes a tab retention opening 118 that corresponds to and is adapted to receive the tab 63 formed on the finger follower 54 so as to secure the retention device 98 to the finger follower 54. In the representative embodiment illustrated herein, the tab 63 formed on the distal end 65 of the finger follower 54 is substantially rectangular in shape. Concomitantly, the tab retention opening 118 is similarly shaped so as to receive the tab 63 in snug and secure fashion. However, those having ordinary skill in the art will appreciate that the tab 63 and corresponding opening 118 may have any suitable geometric shape.

The upper member 104 includes a bearing retention mechanism, generally indicated at 120, that limits movement of the bearing 58 of the finger follower 54 along the slots 70 and retains the bearing 58 relative to the valve actuating mechanism prior to mounting the valve actuating mechanism as a part of the internal combustion engine. In this context, those having ordinary skill in the art will appreciate that, for example, during shipping and handling of these components, and prior to final installation, the shaft of the bearing may be free to move along the open-ended slots 70 defined in the pair of side walls 66 of the finger follower 54. The bearing retention mechanism 120 acts to prevent the bearing 58 from separating from the finger follower 54.

To this end, the bearing retention mechanism 120 includes at least one prong 122 that extends toward the body 60 of the finger follower 54 and a bearing retention tab 124 that extends at an acute angle relative to the prong 122. In the embodiment disclosed herein, the upper member 104 of the retention device 98 also includes a hole 126 that is adapted to receive the dome-shaped upper surface 95 of the socket 64 formed in the finger follower 54. Thus, the cooperation of the dome-shaped upper surface 95 of the socket in the hole 126 acts as a third connection point between the retention device 98 and the components of the valve actuating mechanism. In the embodiment disclosed herein, the upper member 104 includes two prongs 122 extending toward a portion of the body 60 of the finger follower 54. The prongs 122 are spaced relative to each other on either side of the bearing 58 supported in the finger follower 54 and each extends at acute angles relative to the bearing retention tab 124. The terminal end 128 of each of the prongs 122 is disposed adjacent to the bosses 92 formed on the body 60 of the finger follower 54. Each of the prongs 122 formed on the upper member 104 has a substantially rectangular shape that defines a longitudinal axis and a transverse axis disposed perpendicular to the longitudinal axis. The length of the longitudinal axis is greater than the transverse axis. Thus, in the embodiment illustrated herein, each of the prongs 122 has a substantially rectangular shape. However, those having ordinary skill in the art will appreciate that the prongs 122 may have any similar shape.

Similarly, the bearing retention tab 124 has a substantially rectangular shape that defines a longitudinal axis and a transverse axis disposed perpendicular to the longitudinal axis where the longitudinal axis is greater than the transverse axis. However, those having ordinary skill in the art will appreciate that the bearing retention tab 124 may have any similar shape.

The upper member 104 extends in a substantially arcuate fashion from the intermediate member 106 to the terminal end 128 of the prongs 122 so as to conform to the dome-shaped upper surface 95 of the socket 64 defined by the finger follower 54. In one embodiment, the retention device 98 is an integral, one-piece element made of steel. The various components of the retention device 98, including the upper member 104, the lower member 102, the intermediate member 106 along with each of the subcomponents and apertures may be formed in a stamping process. However, those having ordinary skill in the art will appreciate that the retention device 98 of the present invention could be made of any suitable material and that it is not necessary that it be made from steel.

In operation, movement of the bearing 58 toward the bearing retention tab 124 as the bearing shaft slides along the slots 70 formed in the side walls 66 of the finger follower 54 will cause the bearing 58 to engage the bearing retention tab 124. Engagement of the bearing 58 with the bearing retention tab 124 will likewise move the terminal ends 128 of the prongs 122 into engagement with the bosses 92 formed on the body 60 of the finger follower 54. When the prongs 122 engage the body 60 of the finger follower 54, any further movement of the prongs 122 is stopped. Likewise, this also stops any movement of the bearing retention tab 124. In this way, the lower member 102 and upper member 104 cooperate to limit further movement of the bearing 58, thereby retaining it relative to the valve actuating mechanism. Such movement is, typically, only possible during shipping and handling, as well as prior to final assembly of the valve actuating mechanism on an internal combustion engine. Once the valve actuating mechanism has been installed in the cylinder head of an internal combustion engine, other components prevent any movement of the lash adjuster relative to the finger follower and, likewise, any movement of the bearing shaft along the slots formed in the side walls of the finger follower.

Thus, the valve actuating mechanism of the present invention includes a retention device 98 which operatively couples the lash adjuster 52 and the finger follower 54 together and further prevents separation of the bearing 58 from the finger follower 54 prior to final installation on an internal combustion engine. The retention device 98 is therefore a cost-effective mechanism for interconnecting the subcomponents of the valve actuating mechanism and preventing undesirable separation prior to the final installation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A retention device for interconnecting a lash adjuster and a finger follower having a body including a pair of walls spaced laterally from one another and an open-ended slot formed in each of the walls, such that the walls act to support a shaft of a bearing of a valve actuating mechanism for an internal combustion engine, said retention device comprising:

a body having a lower member, an upper member spaced from said lower member and an intermediate member interconnecting said lower and upper members;

said lower member including an aperture which is adapted to be received in a groove of the lash adjuster; and said intermediate member secured to the finger follower such that said retention device interconnects the lash adjuster and the finger follower, said upper member including a bearing retention mechanism having a bearing retention tab that extends toward the bearing such that said bearing retention tab limits movement of the bearing along the open-ended slots formed in each of the walls of the finger follower and retains the bearing relative to the finger follower prior to mounting the finger follower and lash adjuster as part of the valve actuating mechanism of the internal combustion engine.

2. The retention device as set forth in claim 1, wherein said bearing retention mechanism includes at least one prong extending toward the finger follower, said bearing retention tab extending at an acute angle relative to said at least one prong, said bearing retention tab including a terminal end that is spaced from the bearing of the finger follower such that movement of the bearing toward said bearing retention tab and into engagement therewith moves said at least one prong into engagement with the finger follower, thereby limiting further movement of the bearing and retaining same relative to the valve actuating mechanism prior to mounting an assembly as a part of the internal combustion engine.

3. The retention device as set forth in claim 2, wherein the at least one prong of said upper member includes two prongs extending toward the finger follower, spaced relative to each other on either side of the bearing supported in the finger follower and at an acute angle relative to the bearing retention tab.

4. The retention device as set forth in claim 2, wherein said at least one prong on said upper member has a substantially rectangular shape defining a longitudinal axis and a transverse axis disposed perpendicular to said longitudinal axis and wherein a length of said longitudinal axis is greater than the transverse axis.

5. The retention device as set forth in claim 2, wherein said bearing retention tab has a substantially rectangular shape defining a longitudinal axis and a transverse axis disposed perpendicular to said longitudinal axis and wherein said longitudinal axis is greater than the transverse axis.

6. The retention device as set forth in claim 2, wherein said upper member extends in a substantially arcuate fashion from said intermediate member to a terminal end of said at least one prong so as to conform to a dome-shaped upper surface of a socket defined by the finger follower.

7. The retention device as set forth in claim 1, wherein said upper member includes a hole adapted to receive a dome-shaped upper surface of a socket formed in the finger follower.

8. The retention device as set forth in claim 1, wherein said intermediate portion includes a tab retention opening adapted to receive a tab formed on the finger follower so as to secure the retention device to the finger follower.

9. The retention device as set forth in claim 1, wherein said lower member includes a clip portion having an inner edge which substantially defines said aperture, such that said inner edge of said clip portion is received in a groove formed of the lash adjuster, said lower member further including an end portion which is disposed adjacent to a body of the finger follower.

10. The retention device as set forth in claim 1, wherein said retention device is an integral one-piece element made of steel.

11. A valve actuating mechanism for an internal combustion engine, said valve actuation mechanism comprising:

a finger follower having a body defining a pad for engaging a valve, a socket disposed spaced from said pad, a pair of walls spaced laterally from each other and disposed between said pad and said socket, an open-ended slot formed in each of the walls a bearing rotatably supported on a shaft extending between said pair of walls and supported in said slots;

a lash adjuster including a rounded end that is received in said socket of said finger follower and groove formed in said lash adjuster spaced from said rounded end;

a retention device that acts to interconnect said lash adjuster and said finger follower, said retention device including a body having a lower member, an upper member spaced from said lower member and an intermediate member interconnecting said lower and upper members;

said lower member including an aperture which is adapted to be received in said groove of the lash adjuster; and said intermediate member secured to said finger follower such that said retention device interconnects the lash adjuster and the finger follower and including a bearing retention mechanism having a bearing retention tab that extends toward the bearing such that said bearing retention tab limits movement of the bearing along the open-ended slots formed in each of the walls of the finger follower and retains the bearing relative to the said valve actuating mechanism prior to mounting the valve actuating mechanism as part of the internal combustion engine.

12. The valve actuating mechanism as set forth in claim 11, wherein said bearing retention mechanism includes at least one prong extending toward said body of said finger follower, said bearing retention tab extending at an acute angle relative to said at least one prong, said bearing retention tab including a terminal end that is spaced from the bearing of said finger follower such that movement of said bearing toward said bearing retention tab and into engagement therewith moves said at least one prong into engagement with said body of the finger follower, thereby limiting further movement of said bearing and retaining same relative to said valve actuating mechanism prior to mounting said valve actuating mechanism to the internal combustion engine.

13. The valve actuating mechanism as set forth in claim 12, wherein said socket defines a dome-shaped surface, said upper member of said retention device includes a hole adapted to receive said dome-shaped upper surface of said socket formed in the finger follower.

14. The valve actuating mechanism as set forth in claim 13, wherein said upper member extends in a substantially arcuate fashion from said intermediate member to a terminal end of said at least one prong so as to conform to said dome-shaped upper surface of said socket defined by said finger follower.

15. The valve actuating mechanism as set forth in claim 12, wherein the at least one prong of said upper member includes two prongs extending toward a portion of said body of the finger follower, spaced relative to each other on either side of said bearing supported in said finger follower and at an acute angle relative to said bearing retention tab.

16. The valve actuating mechanism as set forth in claim 12, wherein said at least one prong on said upper member has a substantially rectangular shape defining a longitudinal axis and a transverse axis disposed perpendicular to said longitudinal axis and wherein a length of said longitudinal axis is greater than said transverse axis.

17. The valve actuating mechanism as set forth in claim 12, wherein said bearing retention tab has a substantially rectangular shape defining a longitudinal axis and a transverse axis disposed perpendicular to said longitudinal axis and wherein said longitudinal axis is greater said the transverse axis.

18. The valve actuating mechanism as set forth in claim 11, wherein said finger follower includes a tab extending from a distal end of said finger follower opposite said pad, said intermediate portion of said retention device includes a tab retention opening adapted to receive said tab formed on said finger follower so as to secure said retention device to said finger follower.

19. The valve actuating mechanism as set forth in claim 11, wherein said lower member includes a clip portion having an inner edge which substantially defines said aperture, such that said inner edge of said clip portion is received in said groove formed of the lash adjuster, said lower member further including an end portion that is disposed adjacent to the body of the finger follower.

20. The valve actuating mechanism as set forth in claim 11, wherein said retention device is an integral one-piece element made of steel.

* * * * *